US006871611B1

(12) United States Patent
Tormey et al.

(10) Patent No.: US 6,871,611 B1
(45) Date of Patent: Mar. 29, 2005

(54) KAYAK WITH ADJUSTABLE COCKPIT WALLS

(76) Inventors: Peter James Tormey, 2017 Esperanza Dr., Concord, CA (US) 94519; David Timothy Ryan, 2603 Vargus Ct., Concord, CA (US) 94520

( * ) Notice: Subject to any disclaimer, the term of this patent is extended or adjusted under 35 U.S.C. 154(b) by 0 days.

(21) Appl. No.: 10/760,735

(22) Filed: Jan. 20, 2004

(51) Int. Cl.[7] ..... B63B 35/00
(52) U.S. Cl. ..... 114/347
(58) Field of Search ..... 114/343, 347, 114/363, 364

(56) References Cited

U.S. PATENT DOCUMENTS 4,838,196 A * 6/1989 Ingram ..... 114/347
5,542,369 A * 8/1996 Ingram ..... 114/347
6,000,355 A * 12/1999 Hall ..... 114/347
6,129,600 A * 10/2000 Nordby ..... 114/347
6,343,562 B1 * 2/2002 Ingram ..... 114/347

* cited by examiner

*Primary Examiner*—Lars A. Olson

(57) ABSTRACT

In a narrow keeled boat with adjustable walls (10 & 11) and floatation devices 12 & 13) that expand outward to allow for more room in the cockpit and increased stability when needed.

5 Claims, 3 Drawing Sheets

KAYAK WITH ADJUSTABLE COCKPIT WALLS

REFERENCES CITED

Insofar as we are aware there are no other patents or published art where a kayak can adjust the cockpit walls to allow them to act as sponsons. The references below are for different forms of kayak floatation and safety devices.

| | | |
|---|---|---|
| 5,542,369 | Ingram | February 2002 |
| 883,588 | Thatcher | March 1908 |
| D385,528 | Cronin; Paul G | April 1996 |
| 4,838,196 | Ingram; Robert T. | August 1988 |

BACKGROUND OF THE INVENTION

This invention relates to kayak safety and comfort derived from an adjustable kayak cockpit that expands to allow more room for the kayaker while providing additional lateral safety by extending the cockpit walls outward as sponsons.

Traditionally kayak cockpits fit tight because kayakers use their hips and knees to steer the kayak. This invention allows the kayaker to open the cockpit, giving up some of the control, but allowing them to stretch and readjust their legs in the event of muscle spasms and leg cramps. This invention also allows the kayaker to close the cockpit returning the kayak to its original form.

At times kayakers need to adjust their seating or stretch their legs to stave off cramping. In a kayak that is not possible. This invention allows the kayaker to open the cockpit and move about. When the cockpit is opened the walls act as sponsons giving sufficient stability for the kayaker to move about. This invention can be added to existing designs without penalizing the hull shapes and control surfaces of the kayak and does not require hauling any additional equipment on the deck of the kayak, which would add wind drag to the kayak.

This invention also increase the safety of kayaking by allowing for the cockpit to be opened in the event of capsize. This makes it easier for kayakers to return to the cockpit.

The advantage to this invention is that is requires very few changes to the existing kayak hull shape and design. The disadvantage to this invention is that when the cockpit is open the kayaker will have reduced paddling efficiency and the waterline will be reduced.

DRAWINGS

There are three drawing in this patent application.

REFERENCE NUMBERS

10. Cockpit left side

11. Cockpit right side

12. Float right side

13. Float left side,

14. Fastener right side

15. Fastener left side

16. Hinge right side

17. Hinge left side

18. seal.

DETAILED DESCRIPTION

Figure 1:
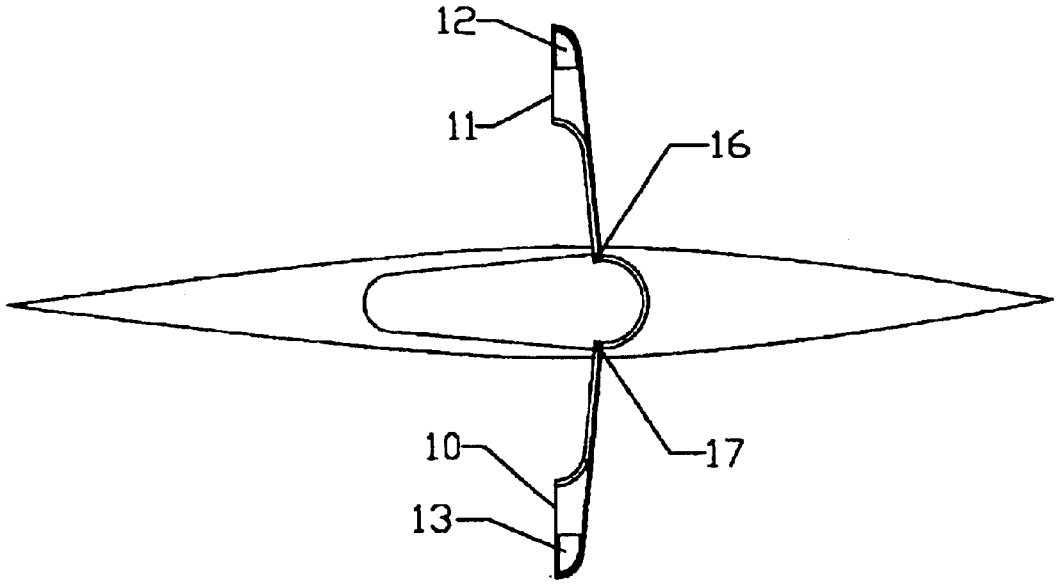
FIG. 1 is a top view showing the cockpit walls extended

FIG. 1 is a top view showing the cock pit walls extended. Items ten (10) and eleven (11) are the cockpit walls modified to be mounted on hinges item six teen (16) and item seventeen (17). Items twelve (12) and thirteen (13) are floats attached to the cockpit walls (10 & 11).

Items fourteen 14) and fifteen (15) are fasteners used to hold the cockpit walls securely to the kayak when not opened. Item 18 is a seal to prevent water from entering the kayak when the cockpit walls are closed.

Figure 2:
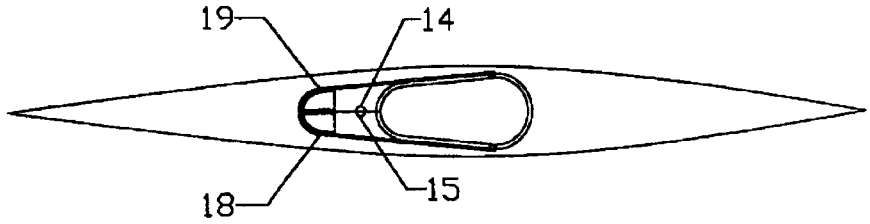
FIG. 2 is a top view showing the cockpit walls closed
Figure 3:
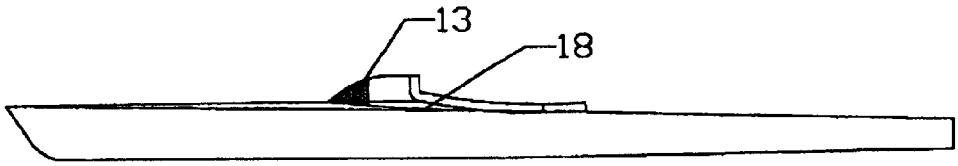
FIG. 3 is a side view with the cockpit walls closed

Operation:

In normal operation the kayak walls are closed as in FIGS. 2 and 3. When the kayaker needs to move his legs or needs additional stability they unfasten items fourteen and fifteen and extend the cockpit walls outwards. The extended cockpit walls allow more room in the cockpit and provide stability while the kayaker moved about.

We claim:

1. In a narrow keeled boat, an improvement consisting of:

a. a cockpit with adjustable walls and a means of floatation mounted on said cockpit walls that can be extended outwards b. a means of connecting said cockpit walls to said boat that allows for pivoting said cockpit walls c. a means to seal the cockpit to reduce water intrusion into the cockpit when said cockpit walls are closed and d. a means to fasten said cockpit walls together.

2. The improvement of claim 1 in which the said means of floatation is adjustable to give greater buoyancy using less space.

3. The improvement of claim 1 in which the said means of floatation is inflatable to give greater buoyancy using less space.

4. The improvement of claim 1 with a means of suspending a rope ladder to said cockpit walls that will allow a boater to enter said boat more easily in the event of a capsize.

5. The improvement of claim 1 where the said cockpit walls are mounted on pivoting devices that can be locked in position.

* * * * *